US005448876A

United States Patent [19]

Menayan

[11] Patent Number: 5,448,876

[45] Date of Patent: Sep. 12, 1995

[54] MACHINE FOR APPLYING HEAT SHRINKABLE BANDS TO CONTAINERS

[76] Inventor: Victor V. Menayan, 103 Rothschild Pl., Cary, N.C. 27511

[21] Appl. No.: 71,097

[22] Filed: Jun. 4, 1993

[51] Int. Cl.[6] ..... B65B 9/10

[52] U.S. Cl. ..... 53/399; 53/292; 53/296; 53/585

[58] Field of Search ..... 53/291, 292, 293, 296, 53/315, 316, 399, 487, 585

[56] References Cited

U.S. PATENT DOCUMENTS

| | | | |
|---|---|---|---|
| 3,888,067 | 6/1975 | Cross et al. | 53/292 |
| 4,293,364 | 10/1981 | Fujio | 53/585 X |
| 4,562,684 | 1/1986 | Dreher | 53/585 X |
| 4,649,697 | 3/1987 | Konstantin | 53/585 |
| 5,024,049 | 6/1991 | Strub et al. | 53/585 |
| 5,070,680 | 12/1991 | Nagano | 53/585 X |

FOREIGN PATENT DOCUMENTS

| | | | |
|---|---|---|---|
| 84829 | 3/1989 | Japan | 53/292 |

*Primary Examiner*—Linda Johnson
*Attorney, Agent, or Firm*—Rhodes, Coats & Bennett

[57] ABSTRACT

The present invention entails a band application machine for applying tamper-evident bands and other bands about the circumference of a container. The band application machine directs a supply strip of banding material to a curing mechanism which cuts the supply strip into a series of cut bands. A band transfer system transfers the cut band to a container being conveyed adjacent to the band application machine on a conveyor assembly. The band transfer system includes a gripping mechanism having a pair of opposing gripper arms with attached suction cups. The gripper arms and attached suction cups engage opposite sides of a closed band and then move apart to open the band. An actuator laterally positions the gripper mechanism to a position where the grippers extend over the conveyor assembly. A tilting actuator rotates the gripper mechanism from a generally horizontal position to a tilted position where a lower section of the gripped band extends into the pathway of the passing containers. A shoe assembly is designed to be longitudinally moveable along the conveyor system from a retracted position to an extended position. The shoe assembly is positioned in the retracted position as the gripping mechanism is moved from the generally horizontal position to the tilted position such that the shoe assembly does not interfere with the positioning of the gripping mechanism. In the extended position, the shoe assembly lies over a band held in the tilted position and effectively limits its upward movement as a passing container strips the band from the tilted position.

24 Claims, 7 Drawing Sheets

MACHINE FOR APPLYING HEAT SHRINKABLE BANDS TO CONTAINERS

FIELD OF THE INVENTION

The present invention relates to machines for applying tamper-evident bands and other bands, and more particularly to a method and apparatus for cutting bands from a supply strip and transferring the cut bands securely about a passing container.

BACKGROUND OF THE INVENTION

For many years, band application machines have been utilized to place bands, particularly heat-shrinkable bands, on passing containers. These heat-shrinkable bands placed on containers enables one to generally determine if the container has been tampered with after filling.

In the past, manufactures have produced various types of band application machines. For example, some of the band application machines are quite sophisticated and expensive, and because of that, are deemed to be high-speed machines as they are able to handle 200 and more containers per minute. As just noted, these machines are relatively expensive and consequently their application is somewhat limited.

There are band application machines that are commercially available that are designed to run at what might be referred to as intermediate speeds. These intermediate speeds would enable the band application machine to handle between 50–200 containers per minute. An example of such an intermediate machine would be a machine such as disclosed in U.S. Pat. Nos. 5,165,215 and 5,197,259 and manufactured by Axon Corporation of Garner, N.C.

However, there exists a need for a relatively inexpensive machine that would apply bands to containers up to a speed of approximately 50 containers per minute. There are applications in the industry today where bands are applied to containers through what is essentially a manual process. There is a need for a relatively inexpensive machine that could be utilized by small packaging businesses that presently apply bands through purely a manual process. It is of course important that while such machines will yield a relatively small number of band containers per minute, that such a machine be dependable and reliable.

Therefore, there is and continues to be a need for a low-speed band application machine that is relatively inexpensive, but which is reliable and dependent.

SUMMARY AND OBJECTS OF THE INVENTION

The present invention entails a low-speed and low-cost band application machine for applying bands to containers. To enhance control of the band position, the band application machine employs an improved band transfer system.

The transfer system of the present invention includes a gripping mechanism having a first gripper for gripping one side of a band and a second gripper for gripping an opposite side of the band. An actuator is used to move the first and second grippers from an open position where the grippers are spaced apart to a closed position where the grippers are positioned adjacent one another so as to grip opposite sides of a cut, closed band located in a band engagement position.

After the cut band has been gripped and opened by the first and second grippers, an actuator laterally positions the gripped band from the band engagement position to a position extending over a conveyor system. By laterally positioning the held band away from the band engagement position to a position over the conveyor assembly, the problem of the band application machine interfering with the path of travel of the containers is eliminated. A tilting mechanism is operatively connected to the first and second grippers to then tilt the grippers downwardly to a band application position where a lower edge of the open band lies in the path of a passing container. A passing container then engages the section of the held band extending into the container's path so as to effect a transfer of the held band from the gripping mechanism to the container.

A shoe is designed to be movably mounted longitudinally along the path of travel of the containers to press a transferred band downwardly onto the container. The shoe is moveable from a retracted position that permits the gripping mechanism to be tilted back and forth so as to clear the shoe assembly and an extended position where the shoe assembly extends over a portion of the downwardly tilted band so as to prevent the band from moving upwardly past the shoe as the tilted band is positioned about a container and moved along the conveyor.

It is therefore an object of the present invention to provide a low speed relatively inexpensive band application machine which is capable of effectively and efficiently applying bands to containers.

Another object of the present invention is to provide a band application machine that laterally displaces a band with respect to an underlying conveyor assembly.

Another object of the present invention is to provide a band application machine that provides a shoe assembly that does not interfere with the movement of a gripper mechanism which moves from a generally horizontal position to a tilted position.

Other objects and advantages of the present invention will become apparent and obvious from a study of the following description and the accompanying drawings which are merely illustrative of such invention.

DETAILED DESCRIPTION OF THE INVENTION

Figure 1:
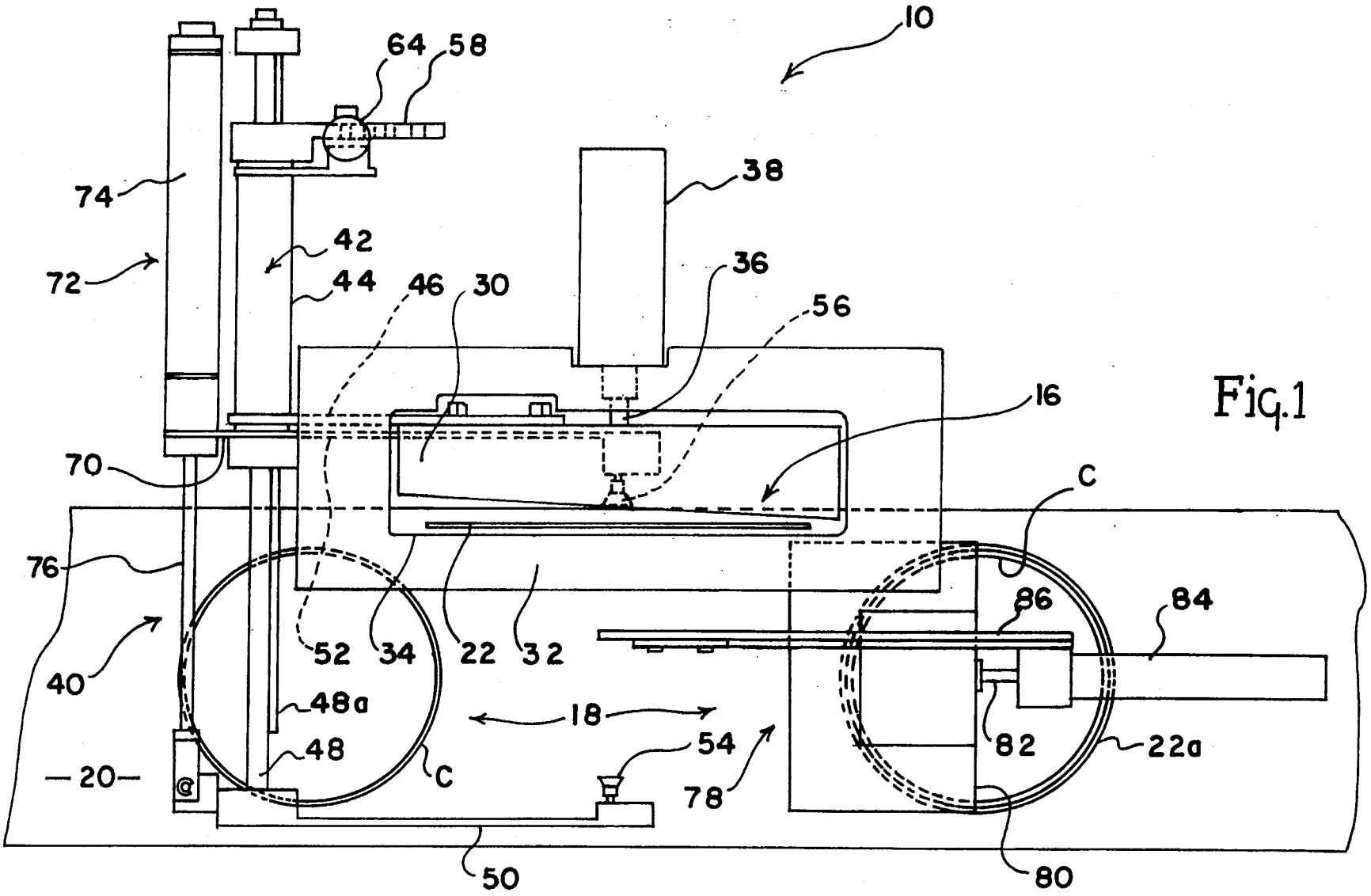
FIGS. 1–5 are a series of top plan views illustrating the transfer of a band from the band application machine of the present invention to a passing container.

The present invention relates to an improved machine for applying tamper-evident bands and other types of bands to containers. Machines for applying tamper-evident bands are well-known in the prior art and are used throughout the world for applying bands to a wide variety of containers. For examples of typical machines for applying bands, one is referred to the disclosures found in U.S. Pat. Nos. 5,165,215; 4,914,893; 2,623,673; 2,751,735; and 3,802,152, these disclosures being expressly incorporated herein by reference. Therefore, in describing the machine of the present invention for applying bands, it will be appreciated that much of the structure and function of the machine is conventional. For that reason, a detailed description of the entire machine will not be dealt with herein in detail because such is not per se material to the present invention and because such band application machines are well known and appreciated by those skilled in the art.

With further reference to the drawings, the machine for applying bands is indicated generally by the numeral 10. Machine 10 of the present invention basically comprises three basic sub-systems, a feed system 14, a cutting mechanism 16, and a transfer system 18. Briefly reviewing each of the systems before proceeding with a detailed description of the invention, it should be pointed out that feed system 14 functions to direct and advance an elongated strip of band material 22 to the cutting mechanism 16. Cutting mechanism 16 cuts the supply strip 22 into individual cut bands **22*a* that are ultimately applied to containers. Once cut, each cut band 22*a* is engaged by the transfer system 18. Transfer system 18 functions to grasp the cut band 22*a* and position the same for an efficient transfer and application onto a passing container being conveyed by a conveyor assembly 20**. A more detailed description of each subsystem follows.

Figure 6:
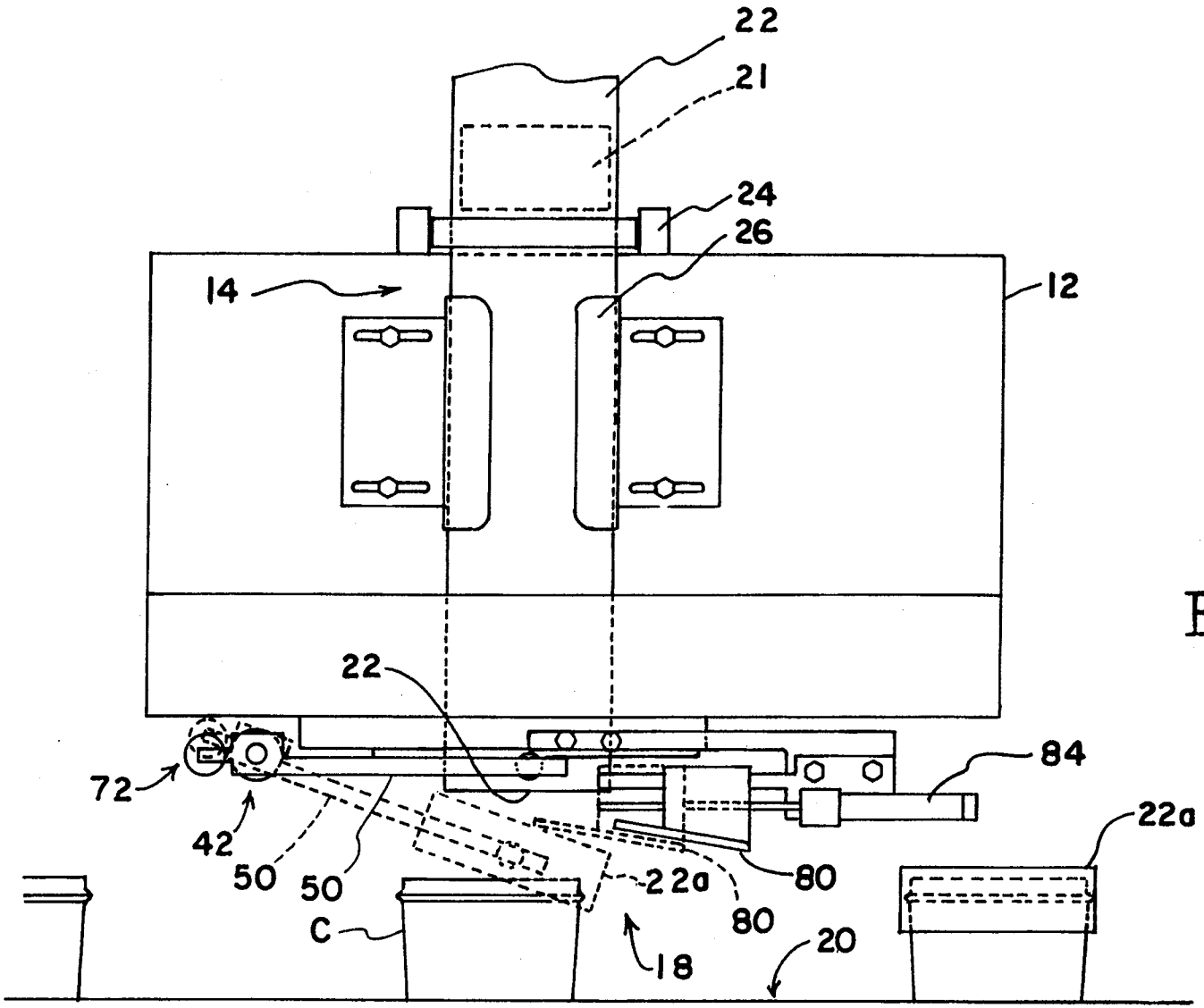
FIG. 6 is a side elevational view illustrating the tilting of the gripper mechanism and held band.

Band feed system 14 is a commonly used type of feed system and is known in the prior art. Accordingly, only a brief description of feed system 14 will be given. As shown in FIG. 6, feed system 14 includes a supply strip 22 that extends through an associated housing. Supply strip 22 is fed from a supply spool (not shown) and continuously feeds through drive rollers 24 which drive supply strip 22 downwardly through guide structure 26. Prior to being fed through drive rollers 24, supply strip 22 passes through a spreading wedge (21) which tends to minimize the creases of the supply strip 22.

Cutting mechanism 16 is disposed below drive rollers 24 and functions to cut the supply strip 22 being fed downwardly thereto in a series of cut bands **22*a*. As shown in FIG. 1–5, cutting mechanism 16 includes a blade 30 and a cooperating cutting plate 32 having a shear edge 34. Blade 30 is connected to a rod 36 extending from a double-acting pneumatic cylinder 38. Pneumatic cylinder 38 and rod 36 move blade 30 back and forth such that the shear edge 34 of blade 30 moves adjacent cooperating cutting plate 32 to cut a band 22*a* from supply strip 22**.

Cut bands **22*a* must be transferred to and positioned on containers C passing on conveyor assembly 20. See FIG. 6 Transfer system 18 is designed to transfer and position bands 22*a* onto containers C, and generally includes a band-gripping mechanism 40 and a shoe assembly 80. Gripper mechanism 40 includes a reciprocating guide assembly 42 that is operatively connected with blade 30 such that guide assembly 42 moves back and forth with blade 30. Guide assembly 42 includes an outer sleeve 44 having a bearing (not shown) secured to the sleeve 44. Secured to the bearing is a carrier arm 46 that is rotatably journalled about the bearing, but which is adapted to move the sleeve 44 and guide assembly 42 axially back and forth with the blade 30**.

A guide rod 48 having a keyway 48a is moveable axially back and forth within sleeve 44. Secured to guide rod 48 is an outer gripper arm 50, while an inner gripper arm 52 is secured to outer sleeve 44 of guide assembly 42. The remote ends of outer gripper arm 50 and inner gripper arm 52 each have at least one suction cup 54 and 56, respectively, attached thereto. Suction cups 54 and 56 oppose each other so as to be capable of engaging opposite sides of a band **22*a***.

Figure 7:
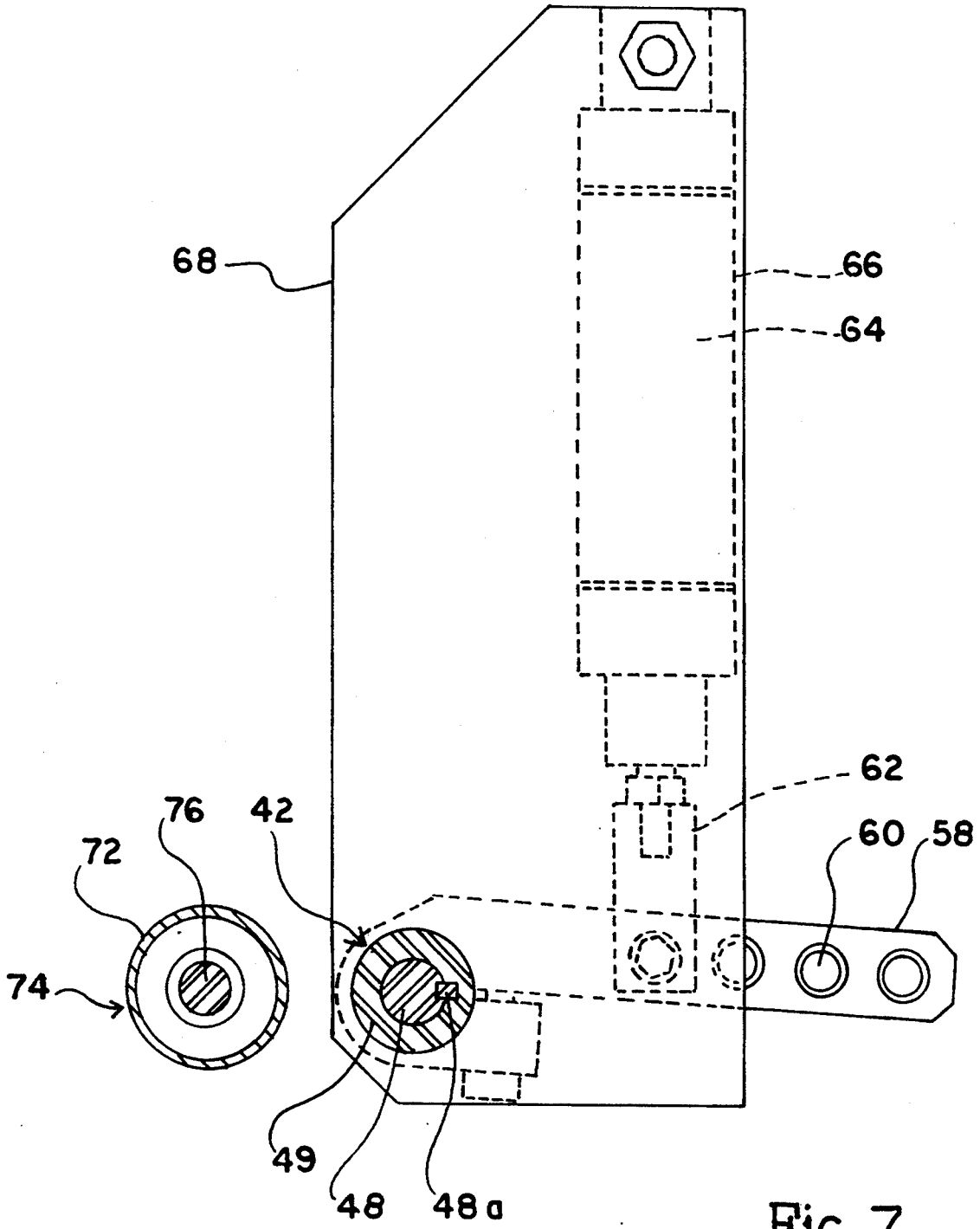
FIG. 7 is a cross-sectional view taken along lines 7–7 of FIG. 5 and showing the gripper mechanism in both a band engagement position and a band application position.

Band application machine 10 is also designed to downwardly tilt gripping mechanism 40. As shown in FIG. 7, to achieve the downward tilting of gripping mechanism 40, a bell-crank arm 58 is fixedly secured to the sleeve 44 of guide assembly 42. Bell-crank arm 58 includes a series of openings 60 extending along the length of bell-crank arm 58 for allowing adjustable attachment of an actuator rod 62. Rod 62 is connected to a double-acting pneumatic cylinder 64 which moves rod 62 back and forth. As rod 62 is moved back and forth, bell-crank arm 58 is moved such that guide assembly 42 is rotated. The degree of rotation of guide assembly 42 is adjustable by attaching rod 62 to a selected opening 60. Housing 66 of pneumatic cylinder 64 is secured to an anchor plate 68 for support.

A bracket 70, as shown in FIGS. 1–5, fixedly secures a double-acting pneumatic cylinder 72 to the outer sleeve 44 of guide assembly 42. Pneumatic cylinder 70 includes a housing 74 and a rod 76 that is moveable back-and-forth. The remote end of rod 76 is secured to outer-gripper arm 50. Because outer gripper arm 50 is attached to rod 76, outer gripper arm 50 moves back and forth as pneumatic cylinder 72 positions rod 76 from a position, shown in FIG. 1, where grippers 50 and 52 are spaced apart to a closed position, shown in FIG. 2, where grippers 50 and 52 are closely adjacent one another.

Transfer system 18 also includes a shoe assembly 78 having a shoe plate 80. Shoe plate 80 is connected to a rod 82 that is moveable back and forth by a double-acting pneumatic cylinder 84. An extendable brace 86 is attached to pneumatic cylinder 84 to provide support for shoe-plate 80. As best shown in FIG. 6, shoe plate 80 is moveable from a retracted position shown in solid lines to an extended position shown in dotted lines.

Referring to FIGS. 1–6, band application machine 10 operates in cycles which begin with the feeding of supply strip 22 to the cutter mechanism 16 and end with a complete application of a cut band **22*a*** to a container C. A description of a single cycle follows.

At the beginning of a cycle, band application machine 10 is orientated as shown in FIG. 1. Feed system 14 feeds supply strip 22 downwardly through the opening located between shear edge 34 of blade 30 and cooperating cutting plate 32. In particular, drive rollers 24 are rotated a selected number of revolutions to cause a selected length of supply strip 22 to extend past blade 30. The length of supply strip 22 extended past blade 30 determine the thickness a height of the band **22*a*** to be cut.

Figure 2:
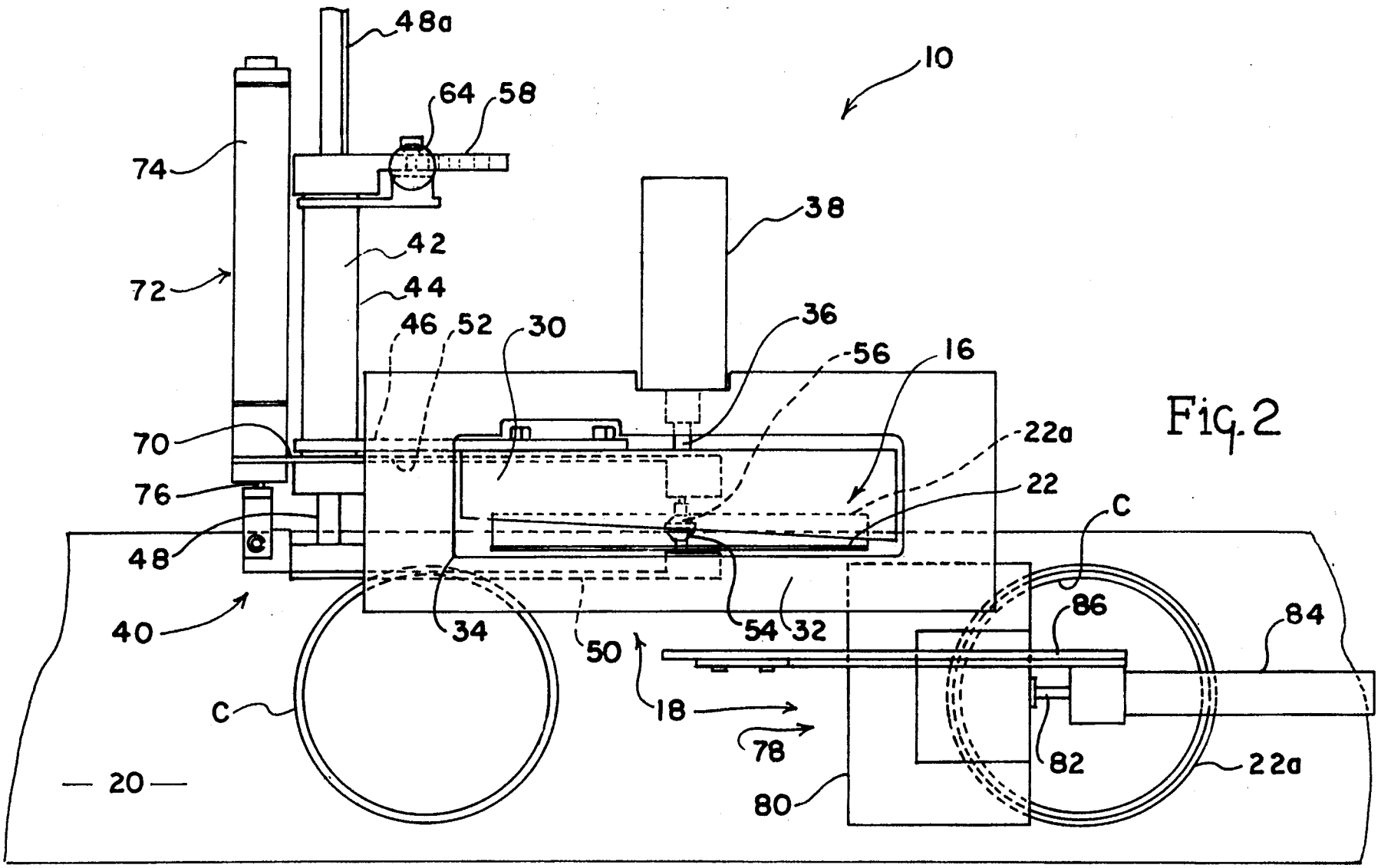

Once rollers 24 have extended supply strip 22 downwardly a selected length past blade 30, double-acting pneumatic cylinder 72 is signalled to reposition rod 76 from the extended position shown in FIG. 1 to a retracted position shown in FIG. 2. Because rod 76 is attached to gripper arm 50 and guide rod 48, gripping mechanism 40 is positioned from a spaced-apart position shown in FIG. 1 to a position shown in FIG. 2 where gripper arms 50 and 52 are positioned adjacent one another.

Opposing sides of the section of supply strip 22 that extends beyond blade 30 is engaged by suction cups 54 and 56 of grippers 50 and 52 when grippers 50 and 52 are positioned adjacent one another. As shown in FIG. 2, suction cup 54 of outer gripper 50 initially engages supply strip 22 and moves supply strip 22 toward suction cup 56 which is attached to inner gripper arm 52. A vacuum source (not shown) is connected to suction cups 54 and 56 so that as the suction cups 54 and 56 engage supply strip 22 a vacuum is produced and supply strip 22 is gripped.

Figure 3:
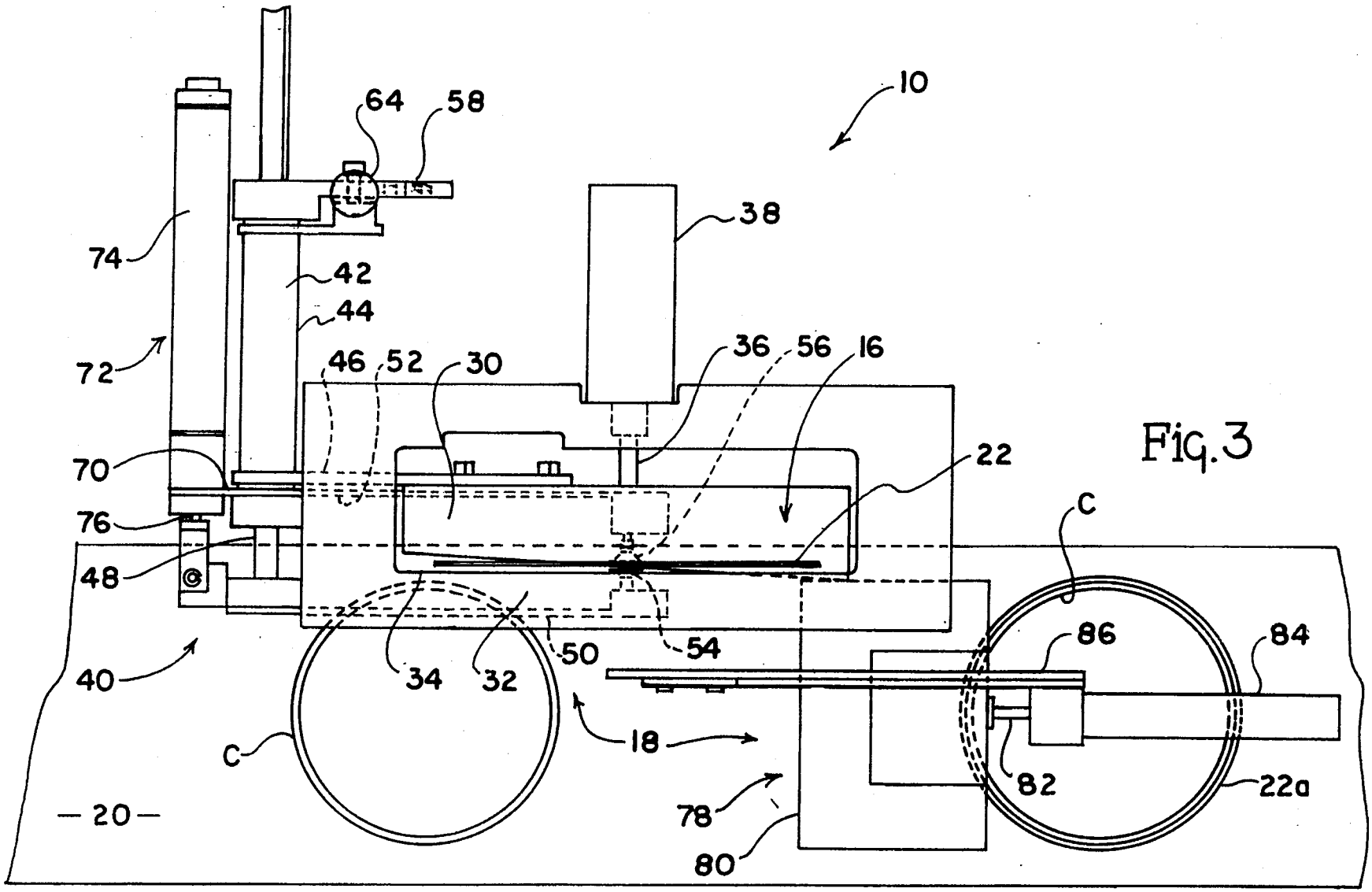

Double-acting pneumatic cylinder 38, which is operatively connected to blade 30, is then signalled to extend rod 36. As rod 36 is extended, blade 30 moves forward. Shear edge 34 of blade 30 moves adjacent cooperating cutting plate 32 as blade 30 is moved forward, as shown in FIG. 3, such that supply strip 22 is cut to form a cut band **22*a*. The cut band 22*a* is gripped by gripping mechanism 40**.

Figure 4:
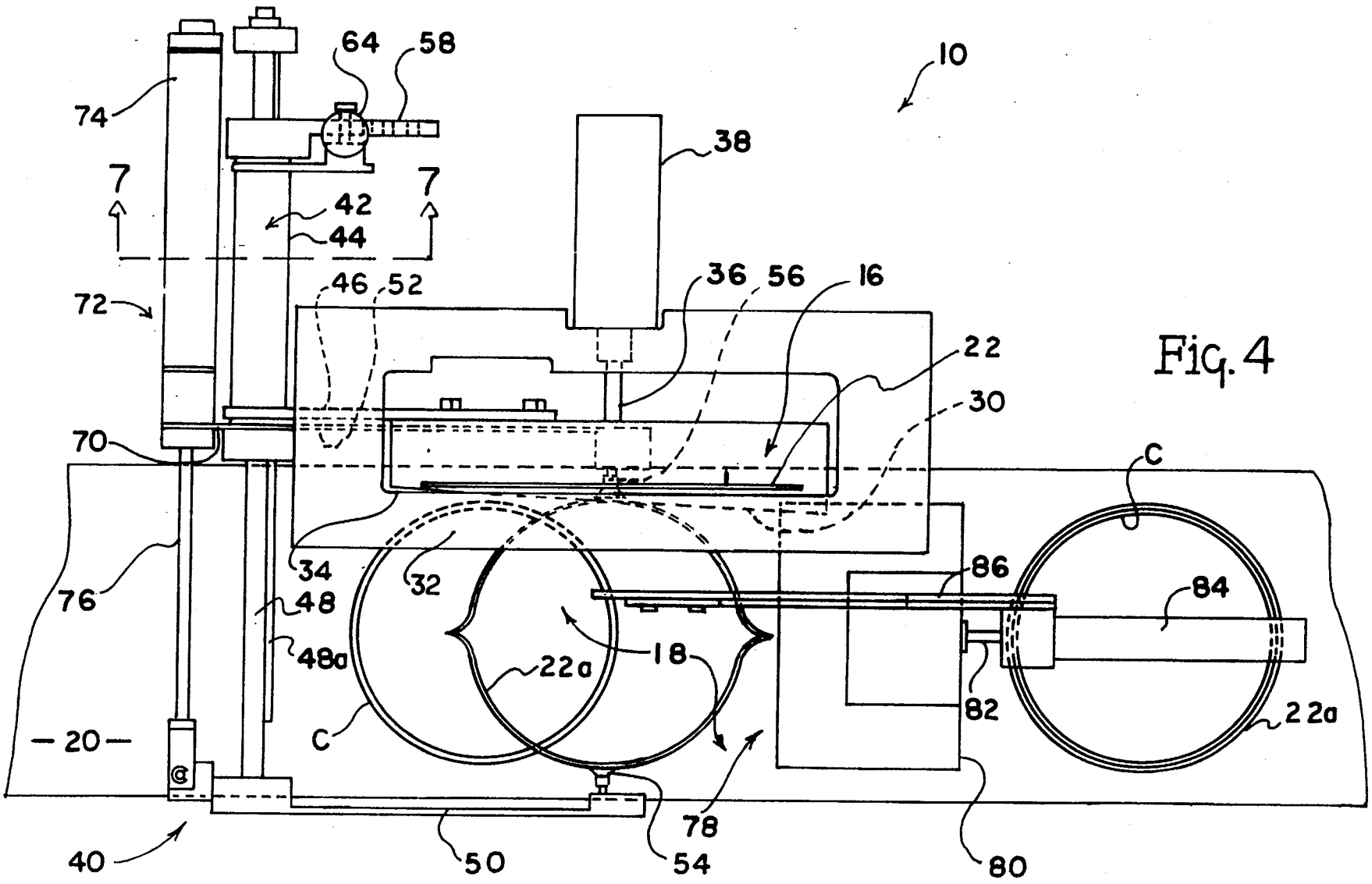

The positioning of blade 30 also results in the positioning of guide assembly 42 and attached pneumatic cylinder 38. In particular, carrier arm 46 connects blade 30 to guide assembly 42 which is in turn connected to pneumatic cylinder 72. Accordingly, as rod 36 moves forward, blade 30, guide assembly 42 and pneumatic cylinder 72 move forward as a unit. As guide assembly 42 moves forward, attached gripper arms 50 and 52 are likewise moved. As shown in FIGS. 2–4, the extension of rod 36 laterally displaces gripper arms 50 and 52 from an initial position generally laterally displaced from conveyor assembly 20 to a position where gripper arms 50 and 52 extend over conveyor assembly 20. Gripper arms 50 and 52 are accordingly laterally displaced from an engagement position where band **22*a* is initially gripped and are laterally displaced to a position located over conveyor system 20**.

After band **22*a* has been cut from supply strip 22, pneumatic cylinder 72 is directed to move rod 76 from its retracted position to its extended position. Attached guide rod 48 of guide assembly 42 is likewise extended from a retracted position to an extended position. As shown in FIG. 4, extending guide rod 48 positions gripper arms 50 and 52 from their adjacent position to a spaced apart position. Gripped band 22*a* is pulled apart from its closed position to an open position as gripper arms 50 and 52 are spread apart such that gripped band 22*a* is disposed in a generally horizontal position over conveyor assembly 20, as shown in FIG. 4**.

Figure 5:
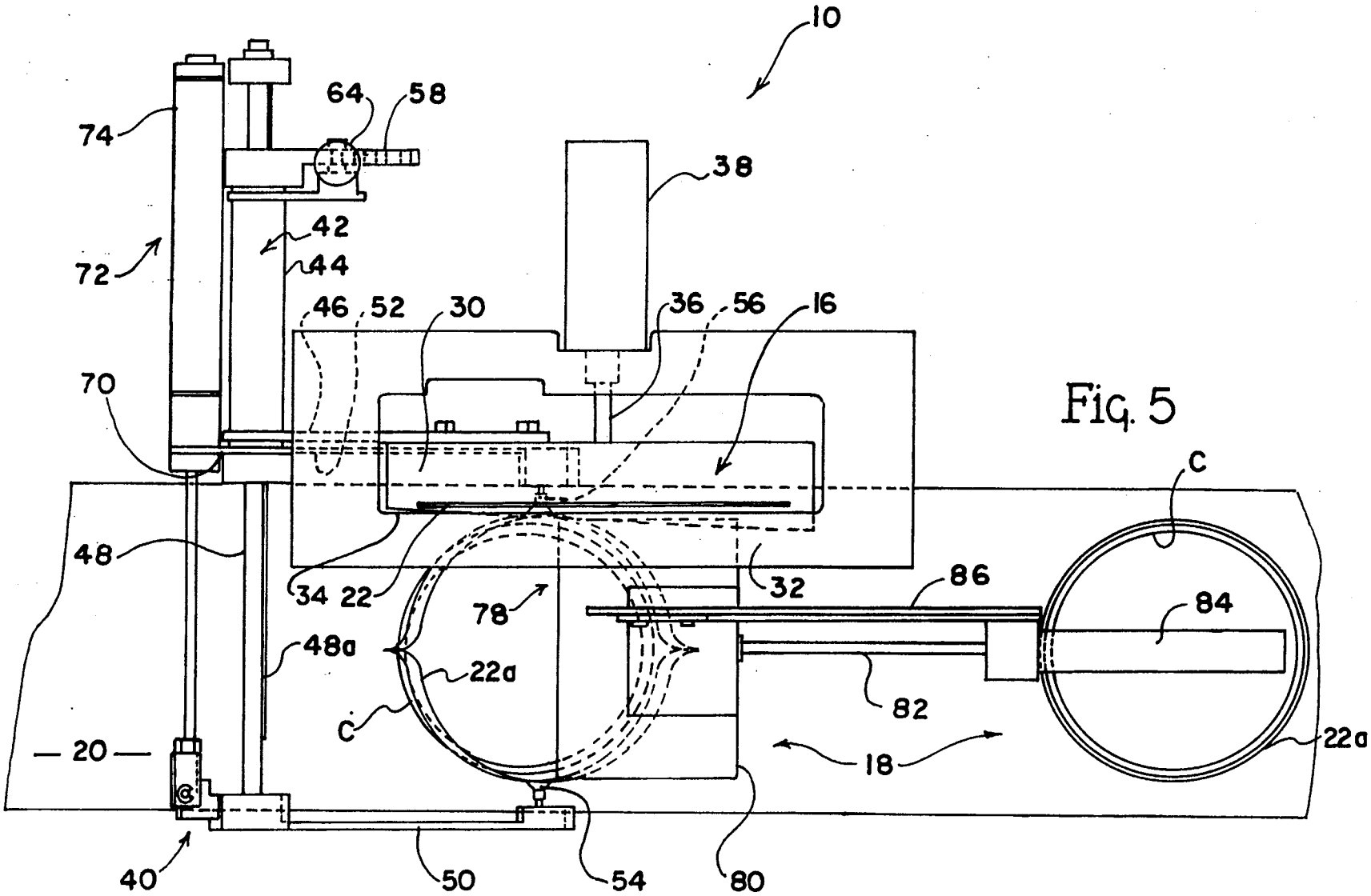

To place band **22*a* in a tilted position, pneumatic cylinder 64 which is also operatively connected to reciprocating guide assembly 42, as shown in FIG. 7, is signalled to extend rod 62. Extending rod 62 moves bell crank arm 58 such that guide assembly 42 is rotated. Guide assembly 42 and attached pneumatic cylinder 74 are rotated in a clockwise direction. Keyway 48a prevents rotational movement of guide rod 48 such that both outer sleeve 44 and guide rod 48 are rotated. Attached gripper arms 50 and 52 are rotated downwardly to a tilted position as shown in FIG. 5 and in FIG. 6. Carrier arm 46 is journalled to outer sleeve 44 and remains stationary as guide assembly 42 rotates. As shown in FIG. 6 (dotted lines), a lower section of the gripped band 22*a* extends into the path of passing container C when the gripper arms 50 and 52** are placed in a tilted position.

A container C passing on conveyor assembly 20 engages the lower section of the band such that band **22*a* is positioned about passing container C. A detector (not shown) such as a photo-electric eye or other similar means is used to detect the position of the passing container on the conveyor assembly 20 and signals for the removal of the vacuum source (not shown) from suction cups 54 and 56 at approximately the time that the passing container engages band 22*a***.

As shown in FIGS. 1–4, shoe plate 80 remains in a retracted position as a band is gripped and positioned from the generally horizontal position shown in FIGS. 1–4 to the tilted position shown in FIG. 5. Placing shoe plate 80 in a retracted position ensures that shoe plate 80 does not interfere with grippers 50 and 52 or held band **22*a* as gripping mechanism 40 is positioned from a generally horizontal position to the tilted position. Shoe assembly 78 positions shoe plate 80 in the extended position shown in FIG. 5 and FIG. 6 (dotted lines) at a time after the grippers 50 and 52** have been placed in the tilted position.

Referring to FIG. 6, the positioning of shoe assembly 78 with respect to gripping mechanism 40 is shown. When gripping mechanism 40 is in a generally horizontal position, shoe plate 80 is in a retracted position as shown by the solid line depiction of gripping mechanism 40 and shoe plate 80. Gripping mechanism 40 and gripped band **22*a* can then be positioned to the tilted position without any interference with shoe plate 78. Gripping mechanism 40 is shown in the tilted position in dotted lines. After gripping mechanism 40 has been moved to the tilted position, shoe plate 80 is extended by rod 82 and pneumatic cylinder 84. Shoe plate 80 is positioned on the extended position at a time just before container C engages band 22*a*. Extended shoe plate 78** is shown in dotted lines.

As shown in FIG. 6, a lower section of a tilted band **22*a* is positioned in the path of travel of containers C being conveyed on conveyor assembly 20. A passing container C engages this lower section and band 22*a* is transferred to the passing container C. A switch is positioned adjacent conveyor assembly 20 to remove the vacuum source (not shown) from suction cups 54 and 56 as pass container C engages band 22*a*** so as to aid in the band transfer to container C.

As passing container C engages band 22, band **22*a* tends to be forced upwardly. Extended shoe plate 80, however, pushes band 22*a* downwardly onto the container C as container C engages tilted band 22*a* so as to aid in transferring band 22*a*** about container C.

After band **22*a* has been transferred from gripping mechanism 40 to container C, shoe plate 80 is retracted. Retracted shoe plate continues to press band 22*a* downwardly onto container C as container C moves past retracted shoe plate 80. Shoe plate 80 is disposed at an inclined angle with respect to conveyor assembly 20 so as to gradually press a band 22*a* downwardly onto container C. After shoe plate 80 has been retracted, gripping mechanism 40 can be positioned to its generally horizontal position without any interference from shoe plate 80. In particular, pneumatic cylinder 64 retracts rod 62 to rotate guide assembly 42 and position attached gripping mechanism 40 to its generally horizontal position. Pneumatic cylinder 38 then retracts rod 36 to laterally move blade 30 and gripping mechanism 40 into the starting cycle position shown in FIG. 1**. The band application cycle is then completed and band application machine is situated to begin the next cycle.

As described above, the band application machine 10 of the present invention provides an improved apparatus and method for transferring bands to containers. The ability to laterally displace gripping mechanism 40 with respect to the conveyor assembly 20 and tilt a band **22*c* gripped on opposite sides to a band application position provides more effective positioning of the band 22*a*. In addition, the ability to longitudinally move shoe plate 80 between a retracted position and an extended position with respect to the position of the gripping mechanism 40 aids in the effective transfer of a band to a container. The overall improved ability to grip and maneuver a band 22***a* and press band 22*a* downwardly onto a container C results in a more effective band application machine 10.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A band application machine for applying bands to containers passing on an underlying conveyor, comprising:

(a) a cutter for cutting a band from a supply strip; and (b) transfer means for transferring a cut band to a passing container, including:

(1) a gripping mechanism having a first gripper for gripping one side of a band and a second gripper for gripping an opposite side of the band;

(2) the gripping mechanism further including a pair of movable arms With each gripper being disposed on a respective movable arm, the movable arms being movable laterally back and forth relative to the underlying conveyor and also tiltable between a generally horizontal position and a tilted position; and (3) an actuator assembly for (1) moving the arms and grippers laterally back and forth with respect to the conveyor between a generally closed position where the grippers grip opposite sides of the band while the band is being cut and an open position where the arms and grippers are spaced apart and the band is held in an open configuration, and (2) tilting the open band between a generally horizontal position and a tilted position where a lower edge of the open band lies in the path of the passing container that engages the lower edge of the band and causes the band to be transferred from the gripping mechanism to the passing container.

2. The device of claim 1 wherein the transfer means further includes:

(a) a shoe movably mounted for longitudinal back and forth movement on the downstream side of the gripping mechanism for assisting in the transfer of bands from the gripping mechanism to the passing container, the shoe being moveable from a retracted position to an extended position where the shoe lies over a portion of the tilted band and tends to hold the band down after the band is engaged by an underpassing container; and (b) shoe-actuating means for moving the shoe longitudinally back and forth between the retracted and extended positions.

3. The device of claim 2 wherein the shoe-actuating means moves the shoe from the extended position downstream to the retracted position after a respective band has been positioned about the container so as to continue to press the band downwardly onto the container as the container moves downstream and so as to provide clearance for the upward movement of the gripping mechanism.

4. The device of claim 1 wherein the cutter is combined with the gripping mechanism, and wherein the cutter cuts a band from the supply strip as the gripping mechanism is laterally moved.

5. The device of claim 4 wherein the gripping mechanism, actuator assembly for moving the first and second grippers between the open and closed positions and the pivoting arms are all integrally constructed and move as a unit as the gripping mechanism is laterally moved.

6. The device of claim 5 wherein the actuator assembly includes a guide assembly and a piston actuator and wherein the moveable arms of the gripping mechanism are secured to the guide assembly and wherein the piston actuator is operatively connected to the guide assembly for rotating the same between two positions and thereby effectuating the tilting of the moveable arms carried by the guide assembly.

7. The device of claim 6 wherein the guide assembly includes a sleeve and rod axially moveable within the sleeve and wherein the rod is moved back and forth within the sleeve as the actuator assembly is actuated.

8. The device of claim 7 wherein the cutter is integral with the sleeve of the guide assembly such that the sleeve moves back and forth with the cutter, and wherein the sleeve is rotatably journalled relative to the cutter such that it may rotate independently of the cutter.

9. A band application machine for applying bands to containers passing on an underlying conveyor, comprising:

(a) cutter means for cutting bands from a supply strip;

(b) a pair of laterally-spaced gripper arms mounted on the machine with each gripper arm having a suction cup mounted thereon;

(c) at least one gripper arm being movably mounted relative to the other gripper arm and moveable laterally across the conveyor such that the gripper arms and suction cups are moveable from a closed position where they engage and hold opposite sides of a generally closed band while the band is being cut from the supply strip by the cutter means to an open position where the gripper arms and suction cups assume laterally-spaced apart positions and the cut band held by the suction cups assumes a generally open circular shape;

(d) means for moving the gripper arms and suction cups between the closed and open positions;

(e) tilt means for tilting the gripper arms back and forth between a generally horizontal position where the suction cups initially engage the cut band and a downwardly-tilted position where the held open band is oriented such that the band is tilted and a portion thereof lies in the path of oncoming containers being conveyed underneath the tilted band;

(f) a shoe assembly disposed generally on the downstream side of the gripper arms and suction cups and moveable generally horizontally back and forth between a retracted position that permits the arms to be tilted back and forth while clearing the shoe assembly and an extended position where the shoe assembly extends over a portion of the downwardly-tilted band and prevents the band from moving upwardly past the shoe as the tilted band is engaged and stripped from the suction cups by an underpassing container; and (g) means for moving the shoe assembly back and forth between its retracted and extended positions.

10. The device of claim 9 wherein the shoe actuating means moves the shoe from the extended position downstream to the retracted position after a respective band has been applied to the container, and wherein the shoe presses the band downwardly onto the passing container while the shoe assembly is in the retracted position.

11. The device of claim 10 wherein the cutter is operatively connected to the pair of gripper arms for moving the same, and wherein the cutter cuts a band from the supply strip as the pair of gripper arms are laterally moved.

12. The device of claim 11 wherein the pair of gripper arms, means for moving the arms between their open and closed positions, and tilting means are integrally constructed and move as a unit as the pair of gripper arms are laterally moved.

13. The device of claim 12 wherein the pair of gripper arms are secured to a guide assembly, and wherein the tilting means comprises a piston actuator operatively connected to the guide assembly for rotating the same between two positions and thereby effectuating the tilting of the laterally-spaced gripper arms carried by the guide assembly.

14. The device of claim 13 wherein the guide assembly includes a sleeve and rod axially moveable within the sleeve and wherein the rod is operatively connected to the means for opening and closing the gripper arms such that the rod is moved back and forth within the sleeve by the means for opening and closing the gripper arms.

15. The device of claim 13 wherein the cutter means is integral with the sleeve of the guide assembly such that the sleeve moves back and forth with the cutter means, and wherein the sleeve is rotatably journalled relative to the cutter means such that the sleeve rotates independently of the cutter means.

16. A method for applying bands to containers being conveyed on a conveyor past a band application machine, comprising the steps of:

(a) feeding a band strip from a supply strip to a cutter, the band initially being in a generally closed, flattened position, and having a first side and an opposite second side;

(b) gripping the closed band on the opposite sides of the band with opposing first and second gripper arms and cutting the band from the supply strip while the band is gripped by the gripper arms and held in an offset position with respect to the centerline of the conveyor;

(c) opening the band by moving at least one of the gripper arms laterally across the conveyor so as to move the first and second gripper arms apart such that the band forms a generally open circular shape;

(d) tilting the gripper arms and the open band from a generally horizontal position to a tilted band application position where a lower portion of the band extends into the container's path of travel; and (e) passing a container under the tilted band and engaging the lower portion of the band and transferring the band from the gripper arms to the passing container.

17. The method for applying bands to containers of claim 16 further including the step of moving a shoe to an extended position immediately over a portion of the tilted band so as to prevent the tilted band from moving upwardly pass the overlying shoe as the band is engaged and stripped by an underpassing container.

18. The method of claim 17 including the step of retracting the shoe from the extended position so as to clear the upper area occupied by the shoe in the extended position such that the gripper arms may freely move upwardly to the band engagement position and return to the band application position without interfering with the shoe.

19. The method of claim 18 further including the step of reciprocating the shoe back and forth between the retracted and extended positions in time relationship to the movement of the gripper arms between the band engagement position and band application position.

20. A method of applying heat shrinkable bands to containers being conveyed along a conveyor comprising the steps of:

(a) feeding a strip of banding material to a cutter;

(b) positioning two lever arms on opposite sides of the banding material with each lever arm having a terminal end portion that includes at least one suction cup;

(c) closing the lever arms by moving at least one lever arm laterally across the conveyor towards the other to a closed position where the suction cups on the terminal ends of the lever arms grip an end portion of the banding material adjacent the cutter;

(d) cutting the banding material while the banding material is held by the suction cups to yield a cut band which is held by the suction cups;

(e) opening the held band and the lever arms by moving at least one lever arm laterally across the conveyor with respect to the other lever arm and in the process opening the cut band being gripped by the suction cups disposed on the terminal end portions of the lever arms;

(f) tilting both lever arms and the held band with respect to the underlying conveyor such that a lower portion of the tilted band lies in the path of a container being conveyed on the conveyor; and (g) engaging the lower portion of the tilted band with a passing container and transferring the cut band from the tilted lever arms to the passing container.

21. The method of claim 20 including the step of engaging the top of the cut band and limiting its upward movement as the container engages the cut band and as the cut band is transferred from the lever arms and suction cups to the passing container.

22. The method of claim 21 wherein the step of engaging the top of the cut band and limiting the upward movement thereof includes the step of moving a shoe back and forth between extended and retracted positions and including engaging the top of the cut band with the shoe as the cut band is being transferred from the lever arms and suction cups to the passing container.

23. The method of claim 22 including retracting the shoe from the position where it initially engages the top of the cut band being transferred to the container to a position spaced from the lever arms such that the lever arms can be rotated from the tilted position where a held cut band is transferred to a passing container to a horizontal position.

24. The method of claim 22 wherein the lever arms rotate up and down between a generally horizontal position and a tilted position and wherein the shoe moves back and forth between an extended position generally overlying the tilted cut band being transferred to a passing container and an extended position where the shoe lies outside the path of movement of the lever arms, and wherein the method entails the step of timing the shoe and the lever arms such that they operate in timed relationship with respect to each other so as to avoid actual interference as the shoe and lever arms move.

* * * * *